US011790846B2

(12) United States Patent
Zhang et al.

(10) Patent No.: US 11,790,846 B2
(45) Date of Patent: Oct. 17, 2023

(54) DISPLAY PANEL, DRIVING METHOD THEREFOR, AND DISPLAY DEVICE

(71) Applicants: Chengdu BOE Optoelectronics Technology Co., Ltd., Sichuan (CN); BOE Technology Group Co., Ltd., Beijing (CN)

(72) Inventors: Wenqiang Zhang, Beijing (CN); Rongjian Yan, Beijing (CN); Wenbin Chen, Beijing (CN)

(73) Assignees: Chengdu BOE Optoelectronics Technology Co., Ltd., Sichuan (CN); BOE Technology Group Co., Ltd., Beijing (CN)

( * ) Notice: Subject to any disclaimer, the term of this patent is extended or adjusted under 35 U.S.C. 154(b) by 6 days.

(21) Appl. No.: 17/767,061

(22) PCT Filed: Jun. 10, 2021

(86) PCT No.: PCT/CN2021/099459
§ 371 (c)(1),
(2) Date: Apr. 7, 2022

(87) PCT Pub. No.: WO2022/012236
PCT Pub. Date: Jan. 20, 2022

(65) Prior Publication Data

US 2022/0375405 A1 Nov. 24, 2022

(30) Foreign Application Priority Data

Jul. 16, 2020 (CN) ..... 202010684881.9

(51) Int. Cl.
*G09G 3/3233* (2016.01)
*G09G 3/20* (2006.01)
*G09G 3/3291* (2016.01)

(52) U.S. Cl.
CPC ..... *G09G 3/3233* (2013.01); *G09G 3/2003* (2013.01); *G09G 3/3291* (2013.01);
(Continued)

(58) Field of Classification Search
CPC .. G09G 3/3233; G09G 3/2003; G09G 3/3291; G09G 2320/0276; G09G 2320/0653; G09G 2320/0673
See application file for complete search history.

(56) References Cited

U.S. PATENT DOCUMENTS

2012/0086742 A1 4/2012 Ikeda et al.
2013/0321485 A1* 12/2013 Eom ..... G09G 3/3208 345/82

(Continued)

FOREIGN PATENT DOCUMENTS

CN 101030357 A 9/2007
CN 104599637 A 5/2015

(Continued)

OTHER PUBLICATIONS

International Search Report for PCT/CN2021/099459 dated Aug. 30, 2021.

(Continued)

*Primary Examiner* — Kenneth B Lee, Jr.
(74) *Attorney, Agent, or Firm* — Ling Wu; Stephen Yang; Ling and Yang Intellectual Property

(57) ABSTRACT

A driving method of a display panel includes: determining a brightness band of the display panel, wherein brightness bands include a first brightness band to an $N^{th}$ brightness band, maximum grayscale brightness of the first brightness band to the $N^{th}$ brightness band decreases sequentially, and each brightness band includes three Gamma correction curves respectively corresponding to a first light emitting unit, a second light emitting unit, and a third light emitting (Continued)

unit each of an $(N-M)^{th}$ brightness band to the $N^{th}$ brightness band also corresponds to at least one duty ratio; determining an input data voltage corresponding to at least one light emitting unit based on a Gamma correction curve that corresponds to the determined brightness band and an image to be displayed; and driving the display panel to display the image based on the determined input data voltage, or the determined input data voltage and the duty ratio.

20 Claims, 6 Drawing Sheets

(52) U.S. Cl.
CPC ..... *G09G 2320/0276* (2013.01); *G09G 2320/0653* (2013.01); *G09G 2320/0673* (2013.01)

(56) References Cited

U.S. PATENT DOCUMENTS

| | | | | |
|---|---|---|---|---|
| 2014/0125714 | A1 | 5/2014 | Pyo | |
| 2015/0097764 | A1 | 4/2015 | Pyo et al. | |
| 2015/0154903 | A1* | 6/2015 | Miura | G09G 3/2003 345/690 |
| 2016/0314761 | A1 | 10/2016 | Kim | |
| 2019/0114971 | A1 | 4/2019 | Choi et al. | |
| 2019/0164474 | A1 | 5/2019 | Suo et al. | |
| 2020/0234655 | A1 | 7/2020 | Bian et al. | |
| 2020/0335042 | A1* | 10/2020 | Son | G09G 3/3291 |
| 2021/0065655 | A1 | 3/2021 | Zhai et al. | |
| 2022/0076616 | A1 | 3/2022 | Liu et al. | |

FOREIGN PATENT DOCUMENTS

| | | | |
|---|---|---|---|
| CN | 108022545 | A | 5/2018 |
| CN | 108962126 | A | 12/2018 |
| CN | 109119023 | A | 1/2019 |
| CN | 109166521 | A | 1/2019 |
| CN | 109697960 | A | 4/2019 |
| CN | 110379368 | A | 10/2019 |
| CN | 110738960 | A | 1/2020 |
| CN | 110782831 | A | 2/2020 |
| CN | 111243499 | A | 6/2020 |
| CN | 111243523 | A | 6/2020 |
| CN | 111785209 | A | 10/2020 |

OTHER PUBLICATIONS

Office Action dated Mar. 29, 2021 for Chinese Patent Application No. 202010684881.9 and English Translation.
Office Action dated Aug. 12, 2021 for Chinese Patent Application No. 202010684881.9 and English Translation.
Notification to Grant Patent Right for Invention dated Jan. 17, 2022 for Chinese Patent Application No. 202010684881.9 and English Translation.

* cited by examiner

DISPLAY PANEL, DRIVING METHOD THEREFOR, AND DISPLAY DEVICE

CROSS-REFERENCE TO RELATED APPLICATIONS

The present application is a U.S. National Phase Entry of International Application No. PCT/CN2021/099459 having an international filing date of Jun. 10, 2021, which claims priority to Chinese Patent Application No. 2020106848819, filed to the CNIPA on Jul. 16, 2020 and entitled "Display Panel, Driving Method Therefor, and Display Device". The entire contents of the above-identified applications are hereby incorporated by reference.

TECHNICAL FIELD

Embodiments of the present disclosure relate to, but are not limited to, the field of display technologies, and particularly to a display panel and a driving method thereof, and a display apparatus.

BACKGROUND

An Organic Light Emitting Diode (OLED) is an active light emitting display device having advantages of self-illumination, wide viewing angle, high contrast, low power consumption, and extremely high response speed, etc., and has been widely used in display products such as mobile phones, tablet computers, and digital cameras. OLED display belongs to a current-driven display. It is required to output a current to an OLED through a pixel circuit to drive the OLED to emit light.

SUMMARY

The following is a summary about subject matters described herein in detail. The summary is not intended to limit scope of protection of claims.

An embodiment of the present disclosure provides a driving method of a display panel. The display panel includes multiple pixel units arranged regularly. At least one of the multiple pixel units includes a first light emitting unit that emits light of a first color, a second light emitting unit that emits light of a second color, and a third light emitting unit that emits light of a third color. Each light emitting unit includes a pixel circuit and a light emitting device electrically connected to the pixel circuit. The pixel circuit includes: a driving sub-circuit, a light emitting control sub-circuit, and a data writing sub-circuit, wherein the driving sub-circuit is electrically connected to the light emitting control sub-circuit and the data writing sub-circuit respectively, the data writing sub-circuit is configured to transmit a data voltage, the light emitting control sub-circuit is configured to control an ON duration of the driving sub-circuit, and the driving sub-circuit is configured to control a current flowing through the light emitting device according to the data voltage within the ON duration. The method includes: determining a brightness band of the display panel, wherein brightness bands include a first brightness band to an $N^{th}$ brightness band, maximum gray-scale brightness of the first brightness band to the $N^{th}$ brightness band decreases sequentially, and each brightness band includes three Gamma correction curves respectively corresponding to the first light emitting unit, the second light emitting unit, and the third light emitting unit; each of an $(N-M)^{th}$ brightness band to the $N^{th}$ brightness band also corresponds to at least one duty ratio, the duty ratio is a valid pulse duty ratio of a light emitting signal line, and the light emitting control sub-circuit controls the ON duration of the driving sub-circuit according to the duty ratio, where N is an integer greater than 1, and M is an integer greater than or equal to 0 and less than N; determining an input data voltage corresponding to at least one light emitting unit based on a Gamma correction curve that corresponds to the determined brightness band and an image to be displayed; and driving the display panel to display the image to be displayed based on the determined input data voltage, or, based on the determined input data voltage and the duty ratio, wherein when the display panel is driven to display each frame of an image in the $(N-M)^{th}$ brightness band to the $N^{th}$ brightness band, a current flowing through each light emitting device is greater than a preset reference current of the each light emitting device and the ON duration is less than a preset reference ON duration.

In some possible implementation modes, the duty ratio corresponding to each of the $(N-M)^{th}$ brightness band to the $N^{th}$ brightness band is less than a preset reference duty ratio. Multiple transistors in the pixel circuit are all P-type transistors, and in multiple Gamma correction curves corresponding to the $(N-M)^{th}$ brightness band to the $N^{th}$ brightness band, a data voltage transmitted from the data writing sub-circuit to a pixel circuit of the first light emitting unit is less than a first reference voltage, a data voltage transmitted from the data writing sub-circuit to a pixel circuit of the second light emitting unit is less than a second reference voltage, and a data voltage transmitted from the data writing sub-circuit to a pixel circuit of the third light emitting unit is less than a third reference voltage, wherein the first reference voltage, the second reference voltage, and the third reference voltage are respectively data voltages transmitted from the data writing sub-circuit to pixel circuits of the first light emitting unit, the second light emitting unit, and the third light emitting unit when the duty ratio corresponding to each of the $(N-M)^{th}$ brightness band to the $N^{th}$ brightness band is the preset reference duty ratio.

In some possible implementation modes, the data voltage transmitted from the data writing sub-circuit to the pixel circuit of the first light emitting unit is between $5/1000$ and $15/1000$ of the first reference voltage, the data voltage transmitted from the data writing sub-circuit to the pixel circuit of the second light emitting unit is between $10/1000$ and $20/1000$ of the second reference voltage, and the data voltage transmitted from the data writing sub-circuit to the pixel circuit of the third light emitting unit is between $6/1000$ and $16/1000$ of the third reference voltage.

In some possible implementation modes, the duty ratio corresponding to each of the $(N-M)^{th}$ brightness band to the $N^{th}$ brightness band is less than a preset reference duty ratio. Multiple transistors in the pixel circuit are all N-type transistors, and in multiple Gamma correction curves corresponding to the $(N-M)^{th}$ brightness band to the $N^{th}$ brightness band, a data voltage transmitted from the data writing sub-circuit to a pixel circuit of the first light emitting unit is greater than a first reference voltage, a data voltage transmitted from the data writing sub-circuit to a pixel circuit of the second light emitting unit is greater than a second reference voltage, and a data voltage transmitted from the data writing sub-circuit to a pixel circuit of the third light emitting unit is greater than a third reference voltage, wherein the first reference voltage, the second reference voltage, and the third reference voltage are respectively data voltages transmitted from the data writing sub-circuit to pixel circuits of the first light emitting unit, the second light emitting unit, and the third light emitting unit when the duty ratio corresponding to each of the $(N-M)^{th}$ brightness band to the $N^{th}$ brightness band is the preset reference duty ratio.

In some possible implementation modes, the duty ratio corresponding to each of the $(N-M)^{th}$ brightness band to the $N^{th}$ brightness band is a preset reference duty ratio, in multiple Gamma correction curves corresponding to the $(N-M)^{th}$ brightness band to the $N^{th}$ brightness band, data voltages transmitted from the data writing sub-circuit to pixel circuits of the first light emitting unit, the second light emitting unit, and the third light emitting unit are respectively a first reference voltage, a second reference voltage, and a third reference voltage. Multiple transistors in the pixel circuits are all P-type transistors. After determining the input data voltage corresponding to at least one light emitting unit, the method further includes: when the determined brightness band is within the $(N-M)^{th}$ brightness band to the $N^{th}$ brightness band, decreasing a duty ratio corresponding to the determined brightness band, decreasing the input data voltage corresponding to the at least one light emitting unit, and making brightness that is generated by using the decreased duty ratio and the decreased input data voltage corresponding to the at least one light emitting unit be equal to grayscale brightness that is generated by using the preset reference duty ratio and the first reference voltage, the second reference voltage, and the third reference voltage.

In some possible implementation modes, the duty ratio corresponding to each of the $(N-M)^{th}$ brightness band to the $N^{th}$ brightness band is a preset reference duty ratio, in multiple Gamma correction curves corresponding to the $(N-M)^{th}$ brightness band to the $N^{th}$ brightness band, data voltages transmitted from the data writing sub-circuit to pixel circuits of the first light emitting unit, the second light emitting unit, and the third light emitting unit are respectively a first reference voltage, a second reference voltage, and a third reference voltage. Multiple transistors in the pixel circuits are N-type transistors. After determining the input data voltage corresponding to at least one light emitting unit, the method further includes: when the determined brightness band is within the $(N-M)^{th}$ brightness band to the $N^{th}$ brightness band, decreasing a duty ratio corresponding to the determined brightness band, increasing the input data voltage corresponding to the at least one light emitting unit, and making brightness that is generated by using the decreased duty ratio and the increased input data voltage corresponding to at least one light emitting unit be equal to grayscale brightness that is generated by using the preset reference duty ratio and the first reference voltage, the second reference voltage, and the third reference voltage.

In some possible implementation modes, N is 9, and M is 1 or 0.

In some possible implementation modes, the duty ratio corresponding to each of the $(N-M)^{th}$ brightness band to the $N^{th}$ brightness band is between 1% and 4%.

In some possible implementation modes, the first light emitting unit is a red light emitting unit, the second light emitting unit is a green light emitting unit, and the third light emitting unit is a blue light emitting unit.

In some possible implementation modes, the pixel circuit includes: a first transistor, a control electrode of which is connected to a second scanning signal line, a first electrode of which is connected to a first initial signal line, and a second electrode of which is connected to a second node; a second transistor, a control electrode of which is connected to a first scanning signal line, a first electrode of which is connected to the second node, and a second electrode of which is connected to a third node; a third transistor, a control electrode of which is connected to the second node, a first electrode of which is connected to a first node, and a second electrode of which is connected to the third node; a fourth transistor, a control electrode of which is connected to the first scanning signal line, a first electrode of which is connected to a data signal line, and a second electrode of which is connected to the first node; a fifth transistor, a control electrode of which is connected to a light emitting signal line, a first electrode of which is connected to a second power supply line, and a second electrode of which is connected to the first node; a sixth transistor, a control electrode of which is connected to the light emitting signal line, a first electrode of which is connected to the third node, and a second electrode of which is connected to a first electrode of a light emitting device; a seventh transistor, a control electrode of which is connected to the first scanning signal line, a first electrode of which is connected to a second initial signal line, and a second electrode of which is connected to the first electrode of the light emitting device, a second electrode of the light emitting device being connected to the first power supply line; and a storage capacitor, a first terminal of which is connected to the second power supply line and a second terminal of which is connected to the second node.

An embodiment of the present disclosure also provides a display panel, which is driven by using the driving method of the display panel as described above.

An embodiment of the present disclosure also provides a display apparatus, including the foregoing display panel.

Other aspects may be understood upon reading and understanding of accompanying drawings and the implementation modes of the present disclosure.

BRIEF DESCRIPTION OF DRAWINGS

The accompanying drawings are used for providing further understanding of technical solutions of the present disclosure, constitute a part of the specification, and are used for explaining the technical solutions of the present disclosure together with the embodiments of the present disclosure, and do not constitute limitations on the technical solutions of the present disclosure. Shapes and sizes of various components in the accompanying drawings do not reflect actual scales and are only intended to illustrate contents of the present disclosure.

DETAILED DESCRIPTION

Figure 1:
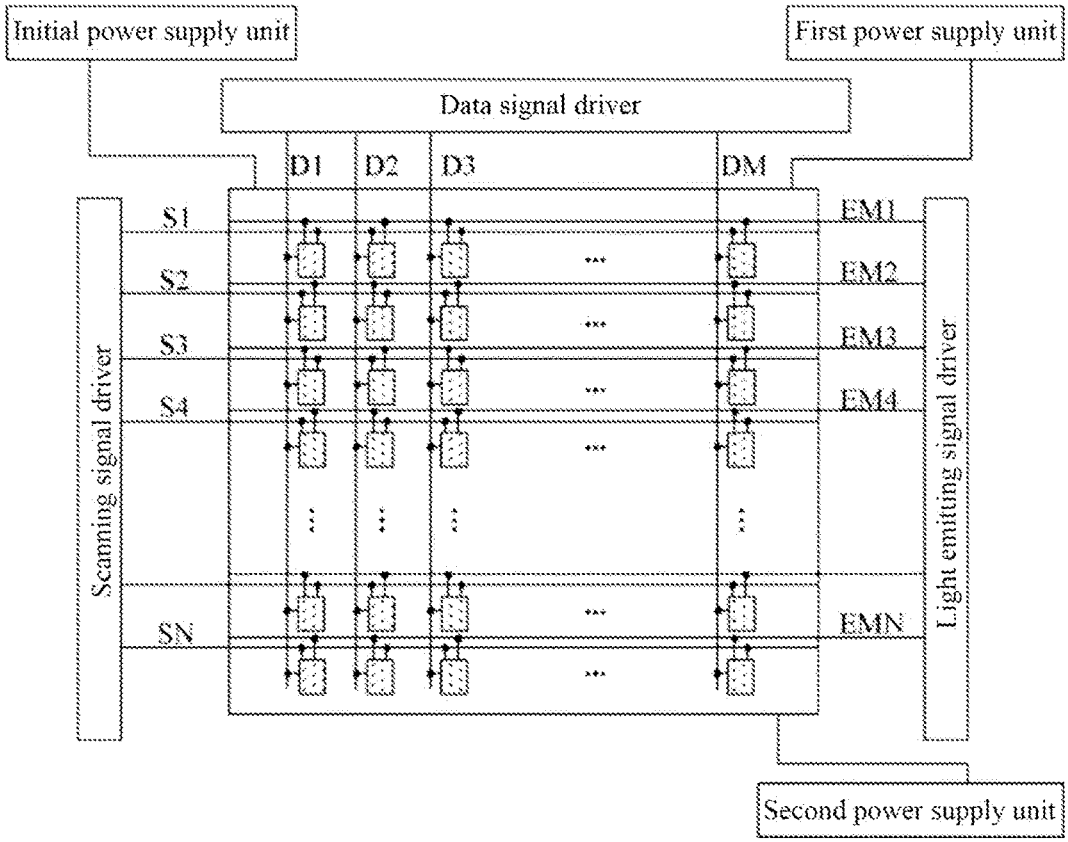
FIG. 1 is a schematic diagram of a structure of a display apparatus according to an exemplary embodiment of the present disclosure.

Implementation modes herein may be implemented in multiple different forms. Those of ordinary skills in the art may readily appreciate a fact that the implementation modes and contents may be varied into various forms without departing from the spirit and scope of the present disclosure. Therefore, the present disclosure should not be construed as only being limited to the contents recorded in following embodiments. The embodiments in the present disclosure and features in the embodiments may be combined with each other randomly if there is no conflict.

In the accompanying drawings, a size of a constituent element, a thickness of a layer, or a region may be sometimes exaggerated for clarity. Therefore, any one implementation mode of the present disclosure is not necessarily limited to dimensions shown in the drawings, and the shapes and sizes of components in the accompanying drawings do not reflect actual scales. In addition, the accompanying drawings schematically show ideal examples, and any one implementation mode of the present disclosure is not limited to the shapes, numerical values, or the like shown in the accompanying drawings.

Ordinal numerals such as "first", "second", and "third" herein are set to avoid confusion between constituent elements, but are not intended to limit in terms of quantity.

Herein, for convenience, wordings indicating orientations or positional relationships, such as "center", "upper", "lower", "front", "back", "vertical", "horizontal", "top", "bottom", "inside", "outside", and the like are used for describing positional relationships between constituent elements with reference to the accompanying drawings, and are merely for facilitating describing the implementation modes and simplifying the specification, rather than indicating or implying that referred apparatuses or elements must have particular orientations, and be constructed and operated in the particular orientations. Thus, they cannot be construed as a limitation on the present disclosure. The positional relationships between the constituent elements may be appropriately changed according to directions according to which the constituent elements are described. Therefore, appropriate replacements may be made according to situations without being limited to the wordings described in the specification.

Herein, unless otherwise specified and defined explicitly, terms "mount", "mutually connect", "connect", and the like should be understood in a broad sense. For example, it may be a fixed connection, or a detachable connection, or an integral connection. It may be a mechanical connection or an electrical connection. It may be a direct connection, or an indirect connection through an intermediate, or communication inside two elements. For those of ordinary skills in the art, meanings of the abovementioned terms in the present disclosure may be understood according to situations.

Herein, a transistor refers to an element at least including three terminals, i.e., a gate electrode, a drain electrode, and a source electrode, and may be a thin film transistor or a field effect transistor or another device with same characteristic. The transistor has a channel region between a drain electrode (or referred to as a drain electrode terminal, a drain region, or a drain electrode) and a source electrode (or referred to as a source electrode terminal, a source region, or a source electrode), and a current may flow through the drain electrode, the channel region, and the source electrode. Herein, the channel region refers to a region through which the current mainly flows.

Herein, the gate electrode of the transistor is referred to as a control electrode, a first electrode may be the drain electrode, and a second electrode may be the source electrode; or the first electrode may be the source electrode, and the second electrode may be the drain electrode. Herein, functions of the "source electrode" and the "drain electrode" are sometimes interchangeable with each other in a case that transistors with opposite polarities are used or a direction of a current is changed during circuit operation. Therefore, the "source electrode" and the "drain electrode" are interchangeable herein.

Herein, the "electrical connection" includes a case that constituent elements are connected together through an element with some electrical action. There is no specific restriction on the "element with some electrical action" as long as electrical signals may be sent and received between the connected constituent elements. For example, the "element with some electrical action" may be an electrode or a wiring, or a switching element such as a transistor, or another functional element such as a resistor, an inductor, and a capacitor.

Herein, "parallel" refers to a state in which an angle formed by two straight lines is above −10° and below 10°, and thus also includes a state in which the angle is above −5° and below 5°. In addition, "perpendicular" refers to a state in which an angle formed by two straight lines is above 80° and below 100°, and thus also includes a state in which the angle is above 85° and below 95°.

Herein, a "film" and a "layer" are interchangeable. For example, a "conductive layer" may be replaced with a "conductive film" sometimes. Similarly, an "insulation film" may be replaced with an "insulation layer" sometimes.

"About" herein refers to that a boundary is defined not so strictly and numerical values within process and measurement error ranges are allowed.

FIG. 1 is a schematic diagram of a structure of a display apparatus according to an exemplary embodiment of the present disclosure. As shown in FIG. 1, an OLED display apparatus may include a scanning signal driver, a data signal driver, a light emitting signal driver, an OLED display panel, a first power supply unit, a second power supply unit, and an initial power supply unit. The display panel at least includes multiple scanning signal lines (S1 to SN), multiple data signal lines (D1 to DM), and multiple light emitting signal lines (EM1 to EMN). The scanning signal driver is configured to sequentially provide scanning signals to the display panel through the multiple scanning signal lines (S1 to SN), the data signal driver is configured to provide data signals to the display panel through the multiple data signal lines (D1 to DM), and the light emitting signal driver is configured to sequentially provide light emitting control signals to the display panel through the multiple lighting signal lines (EM1 to EMN). In an exemplary implementation mode, the multiple scanning signal lines and the multiple light emitting signal lines extend along a horizontal direction, the multiple data signal lines extend along a vertical direction, and the multiple scanning signal lines, light emitting signal lines, and data signal lines intersect to define multiple light emitting units. The first power supply unit, the second power supply unit, and the initial power supply unit are configured to provide a first power supply voltage, a second power supply voltage, and an initial power supply voltage to a pixel circuit through a first power supply line, a second power supply line, and an initial signal line respectively.

Figure 2:
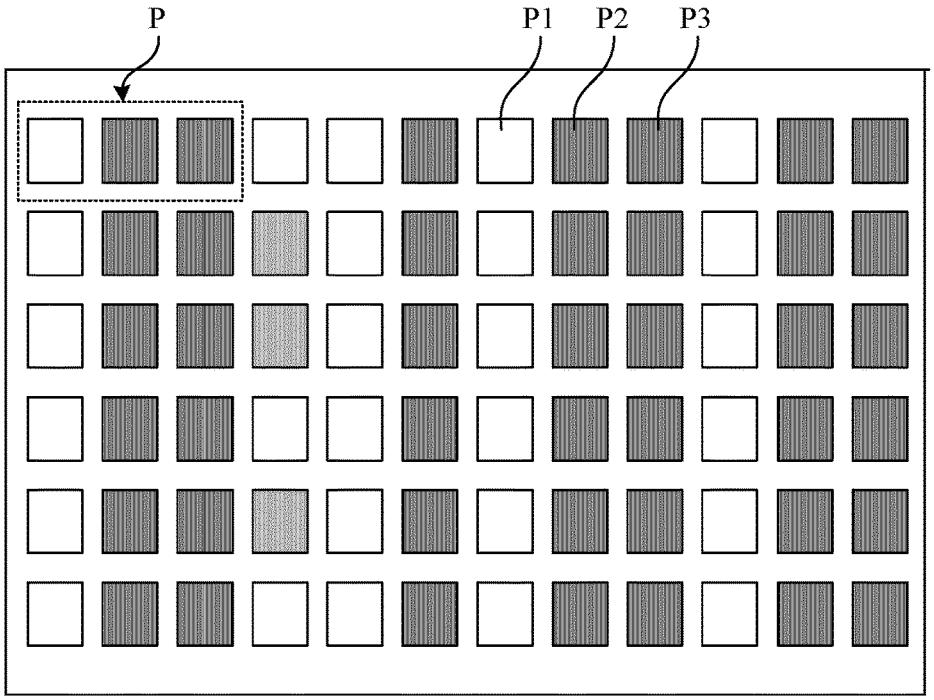
FIG. 2 is a schematic diagram of a planar structure of a display panel according to an exemplary embodiment of the present disclosure.

FIG. 2 is a schematic diagram of a planar structure of a display panel according to an exemplary embodiment of the present disclosure. As shown in FIG. 2, the display panel includes multiple pixel units P arranged in a matrix manner. At least one of the multiple pixel units P includes a first light emitting unit P1 that emits light of a first color, a second light emitting unit P2 that emits light of a second color, and a third light emitting unit P3 that emits light of a third color. Each of the first light emitting unit P1, the second light emitting unit P2, and the third light emitting unit P3 includes a pixel circuit and a light emitting device. A pixel circuit in each of the first light emitting unit P1, the second light emitting unit P2, and the third light emitting unit P3 is connected to a scanning signal line and a data signal line respectively, and the pixel circuit is configured to, under control of the scanning signal line, receive a data voltage transmitted by the data signal line to output a corresponding current to the light emitting device. A light emitting device in each of the first light emitting unit P1, the second light emitting unit P2, and the third light emitting unit P3 is electrically connected to a pixel circuit of a light emitting unit where the light emitting device is located, and the light emitting device is configured to emit light with a corresponding brightness in response to the current output by the pixel circuit of the light emitting unit where the light emitting device is located.

In an exemplary implementation mode, a pixel unit P may include a red light emitting unit, a green light emitting unit, and a blue light emitting unit, or the pixel unit may include a red light emitting unit, a green light emitting unit, a blue light emitting unit, and a white light emitting unit, which is not limited in the present disclosure. In an exemplary implementation mode, a shape of a light emitting unit in a pixel unit may be a rectangle, a rhombus, a pentagon, or a hexagon. In a case where the pixel unit includes three light emitting units, the three light emitting units may be arranged in parallel in a horizontal direction, in parallel in a vertical direction, or in a manner like a Chinese character "品". In a case where the pixel unit includes four light emitting units, the four light emitting units may be arranged in parallel in a horizontal direction, in parallel in a vertical direction, or in a Square, which is not limited in the present disclosure.

Figure 3:
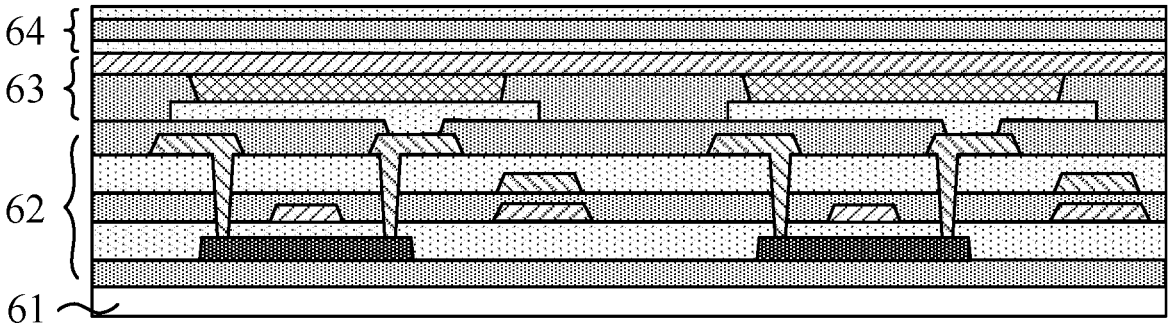
FIG. 3 is a schematic diagram of a sectional structure of a display panel according to an exemplary embodiment of the present disclosure.

FIG. 3 is a schematic diagram of a sectional structure of a display panel according to an exemplary embodiment of the present disclosure, illustrating a structure of two light emitting units of an OLED display panel. As shown in FIG. 3, in a plane perpendicular to the display panel, the display panel includes a driving circuit layer 62 arranged on a base substrate 61, a light emitting structure layer 63 arranged on the driving circuit layer 62, and an encapsulation layer 64 arranged on the light emitting structure layer 63. In some possible implementation modes, the display panel may include other film layers, which is not limited in the present disclosure.

In an exemplary implementation mode, the base substrate 61 may be a flexible base substrate, or a rigid base substrate. The flexible base substrate may include a first flexible material layer, a first inorganic material layer, a semiconductor layer, a second flexible material layer, and a second inorganic material layer that are stacked. The first flexible material layer and the second flexible material layer may be made of a material, such as Polyimide (PI), Polyethylene Terephthalate (PET), or a soft polymer film subjected to a surface treatment. The first inorganic material layer and the second inorganic material layer may be made of silicon nitride (SiNx), silicon oxide (SiOx), or the like, so as to improve a water and oxygen resistance capability of the base substrate. A material of the semiconductor layer may be amorphous silicon (a-si).

In an exemplary implementation mode, the driving circuit layer 62 may include a transistor and a storage capacitor that constitute a pixel circuit. In FIG. 3, each light emitting unit includes a transistor and a storage capacitor as an example for illustration. In some possible implementation modes, a driving circuit layer 62 of each light emitting unit may include: a first insulation layer arranged on the base substrate, an active layer arranged on the first insulation layer, a second insulation layer covering the active layer, a gate electrode and a first capacitance electrode arranged on the second insulation layer, a third insulation layer covering the gate electrode and the first capacitance electrode, a second capacitance electrode arranged on the third insulation layer, a fourth insulation layer covering the second capacitance electrode and having a via exposing the active layer formed thereon, a source electrode and a drain electrode arranged on the fourth insulation layer and respectively connected to the active layer through a via, and a planarization layer covering the foregoing structures. The active layer, the gate electrode, the source electrode, and the drain electrode form a transistor, and the first capacitance electrode and the second capacitance electrode form a storage capacitor. In some possible implementation modes, the first insulation layer, the second insulation layer, the third insulation layer, and the fourth insulation layer may be made of any one or more of silicon oxide (SiOx), silicon nitride (SiNx), and silicon oxynitride (SiON), and may be a single layer, a multi-layer, or a composite layer. The first insulation layer may be referred to as a buffer layer and used for improving a water and oxygen resistance capability of a base substrate. The second insulation layer and the third insulation layer may be referred to as Gate Insulator (GI) layers. The fourth insulation layer may be referred to as an Interlayer Dielectric (ILD) layer. A first metal thin film, a second metal thin film, and a third metal thin film may be made of a metal material, e.g., any one or more of Argentum (Ag), Copper (Cu), Aluminum (Al), Titanium (Ti), and Molybdenum (Mo), or alloy materials of the abovementioned metals, such as an Aluminum-Neodymium alloy (AlNd) or a Molybdenum-Niobium alloy (MoNb), and may be of a single-layer structure, or a multi-layer composite structure such as Ti/Al/Ti. An active layer thin film may be made of amorphous Indium Gallium Zinc Oxide (a-IGZO), Zinc Oxynitride (ZnON), Indium Zinc Tin Oxide (IZTO), amorphous Silicon (a-Si), polysilicon (p-Si), sexithiophene, polythiophene, or another material. That is, the present disclosure is applied to a transistor manufactured based on an oxide technology, a silicon technology, or an organic matter technology. An active layer based on the oxide technology may be made of an oxide containing indium and tin, an oxide containing tungsten and indium, an oxide containing tungsten, indium, and zinc, an oxide containing titanium and indium, and an oxide containing titanium, indium, and tin, an oxide containing indium and zinc, an oxide containing silicon, indium and tin, an oxide containing indium, gallium and zinc, and the like.

In an exemplary implementation mode, the light emitting structure layer 63 may include an anode, a pixel definition layer, an organic light emitting layer, and a cathode. The anode is arranged on the planarization layer, and is connected to the drain electrode through a via formed on the planarization layer. The pixel definition layer is arranged on the anode and the planarization layer, and provided with a pixel opening that exposes the anode. The organic light emitting layer is arranged in the pixel opening. The cathode is arranged on the organic light emitting layer. The organic light emitting layer emits light of a corresponding color under an action of a voltage applied by the anode and the cathode.

In an exemplary implementation mode, the organic light emitting layer may at least include a Hole Injection Layer (HIL), a Hole Transport Layer (HTL), an Emission Layer (EML), an Electron Transport Layer (ETL), and an Electron Injection Layer (EIL) that are stacked. The hole injection layer and the hole transport layer may be collectively referred to as a hole layer, and the electron transport layer and the electron injection layer may be collectively referred to as an electron layer.

In an exemplary implementation mode, the encapsulation layer 64 may include a first encapsulation layer, a second encapsulation layer, and a third encapsulation layer that are stacked. The first encapsulation layer and the third encapsulation layer may be made of an inorganic material, and the second encapsulation layer may be made of an organic material. The second encapsulation layer is arranged between the first encapsulation layer and the third encapsulation layer, which may ensure that outside water vapor cannot enter the light emitting structure layer 63.

In an exemplary implementation mode, the pixel circuit may be of a 5T1C, 5T2C, 6T1C, or 7T1C structure. In some possible implementation modes, the pixel circuit may be of a 6T1C or 7T1C structure, and the storage capacitor should theoretically be charged with a voltage at the end of a charging phase, which is a difference between a data voltage and a threshold voltage of a driving transistor.

Figure 4:
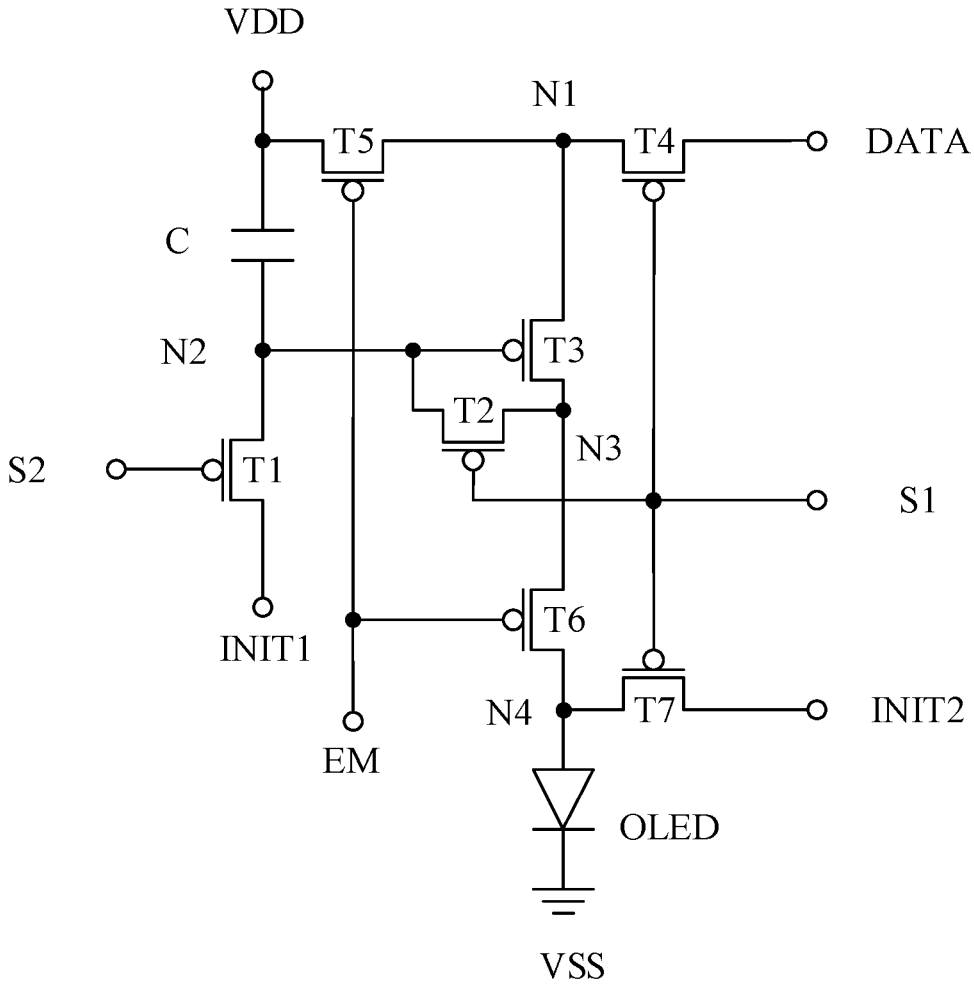
FIG. 4 is an equivalent circuit diagram of a pixel circuit according to an exemplary embodiment of the present disclosure.

FIG. 4 is an equivalent circuit diagram of a pixel circuit according to an exemplary embodiment of the present disclosure. As shown in FIG. 4, the pixel circuit may include seven switching transistors (a first transistor T1 to a seventh transistor T7), one storage capacitor C, and eight signal lines (a data signal line DATA, a first scanning signal line S1, a second scanning signal line S2, a first initial signal line INIT1, a second initial signal line INIT2, a first power supply line VSS, a second power supply line VDD, and a light emitting signal line EM).

In an exemplary implementation mode, a control electrode of the first transistor T1 is connected to the second scanning signal line S2, a first electrode of the first transistor T1 is connected to the first initial signal line INIT1, and a second electrode of the first transistor is connected to a second node N2. A control electrode of the second transistor T2 is connected to the first scanning signal line S1, a first electrode of the second transistor T2 is connected to the second node N2, and a second electrode of the second transistor T2 is connected to a third node N3. A control electrode of the third transistor T3 is connected to the second node N2, a first electrode of the third transistor T3 is connected to a first node N1, and a second electrode of the third transistor T3 is connected to the third node N3. A control electrode of the fourth transistor T4 is connected to the first scanning signal line S1, a first electrode of the fourth transistor T4 is connected to the data signal line DATA, and a second electrode of the fourth transistor T4 is connected to the first node N1. A control electrode of the fifth transistor T5 is connected to the light emitting signal line EM, a first electrode of the fifth transistor T5 is connected to the second power supply line VDD, and a second electrode of the fifth transistor T5 is connected to the first node N1. A control electrode of the sixth transistor T6 is connected to the light emitting signal line EM, a first electrode of the sixth transistor T6 is connected to the third node N3, and a second electrode of the sixth transistor T6 is connected to a first electrode of a light emitting device. A control electrode of the seventh transistor T7 is connected to the first scanning signal line S1, a first electrode of the seventh transistor T7 is connected to the second initial signal line INIT2, and a second electrode of the seventh transistor T7 is connected to the first electrode of the light emitting device. A first terminal of the storage capacitor C is connected to the second power supply line VDD, and a second terminal of the storage capacitor C is connected to the second node N2.

The first transistor T1 to the seventh transistor T7 may be P-type transistors or N-type transistors. Use of a same type of transistors in the pixel circuit may simplify a process flow, reduce process difficulties of a display panel, and improve a yield of a product. In some possible implementation modes, the first transistor T1 to the seventh transistor T7 may include P-type transistors and N-type transistors.

In an exemplary implementation mode, a second electrode of the light emitting device is connected to the first power supply line VSS. A signal of the first power supply line VSS is a low-level signal. A signal of the second power supply line VDD is a high-level signal continuously provided.

In an exemplary implementation mode, the display panel may include a display region and a non-display region, multiple light emitting units are located in the display region, and the first power supply line VSS is located in the non-display region. In some possible implementation modes, the non-display region may surround the display region.

In an exemplary implementation mode, the display panel may include a scanning signal driver, a timing controller, and a clock signal line that are located in the non-display region. The scanning signal driver is connected to the first scanning signal line S1 and the second scanning signal line S2, the clock signal line is connected to the timing controller and the scanning signal driver respectively, and the clock signal line is configured to provide a clock signal to the scanning signal driver under control of the timing controller. In some possible implementation modes, there are multiple clock signal lines, which respectively provide clock signals to multiple scanning signal drivers. In an exemplary implementation mode, the display panel may include a data signal driver that is connected to the data signal line.

In an exemplary implementation mode, the scanning signal lines and the data signal lines vertically intersect to define multiple light emitting units arranged in a matrix manner, the first scanning signal line and the second scanning signal line define a display row, and adjacent data signal lines define a display column. The first light emitting unit P1, the second light emitting unit P2, and the third light emitting unit P3 may be periodically arranged along a display row direction. In some possible implementation modes, the first light emitting unit P1, the second light emitting unit P2, and the third light emitting unit P3 may be periodically arranged along a display column direction.

In an exemplary implementation mode, the first scanning signal line S1 is a scanning signal line in a pixel circuit of a present display row, and the second scanning signal line S2 is a scanning signal line in a pixel circuit of a previous display row. That is, for an $n^{th}$ display row, the first scanning signal line S1 is S(n), and the second scanning signal line S2 is S(n−1). A second scanning signal line S2 of the present display row and a first scanning signal line S1 in the pixel circuit of the previous display row are a same signal line such that signal lines of the display panel may be reduced, and a narrow bezel of the display panel may be achieved.

In an exemplary implementation mode, the first scanning signal line S1, the second scanning signal line S2, the light emitting signal line EM, the initial signal line INIT1, and the second initial signal line INIT2 extend along a horizontal direction, and the first power supply line VSS, the second power supply line VDD, and the data signal line DATA extend along a vertical direction.

In an exemplary implementation mode, the light emitting device may be an Organic Light Emitting Diode (OLED), including a first electrode (anode), an organic light emitting layer, and a second electrode (cathode) that are stacked.

Figure 5:
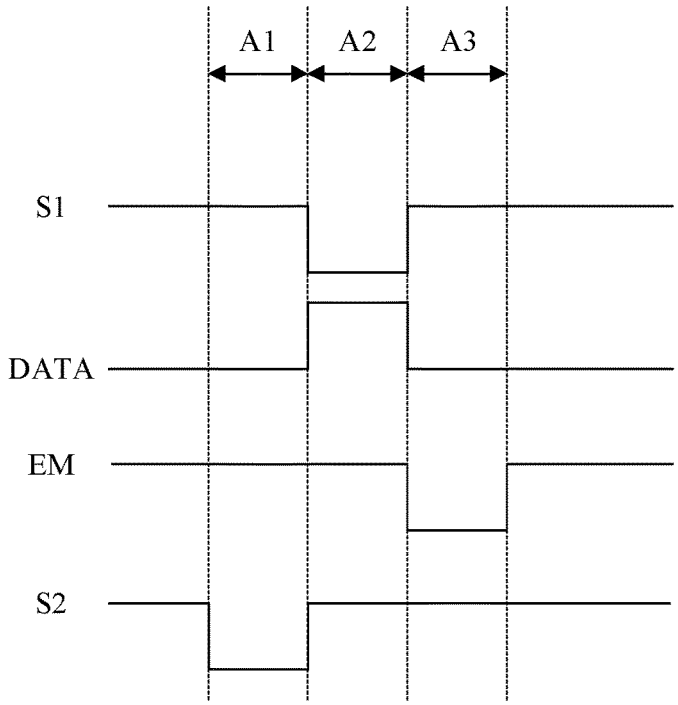
FIG. 5 is a working timing diagram of a pixel circuit according to an exemplary embodiment of the present disclosure.

FIG. 5 is a working timing diagram of a pixel circuit according to an exemplary embodiment of the present disclosure. The exemplary embodiment of the present disclosure will be described below through an operation process of the pixel circuit shown in FIG. 4. In FIG. 4, the pixel driver includes seven transistors (the first transistor T1 to the seventh transistor T7), one storage capacitor C, and eight signal lines (the data signal line DATA, the first scanning signal line S1, the second scanning signal line S2, the first initial signal line INIT1, the second initial signal line INIT2, the first power supply line VSS, the second power supply line VDD, and the light emitting signal line EM). All the seven transistors are P-type transistors.

In an exemplary implementation mode, the operation process of the pixel circuit may include following stages.

In a first stage A1, referred to as a reset stage, a signal of the second scanning signal line S2 is a low-level signal, and signals of the first scanning signal line S1 and the light emitting signal line EM are high-level signals. The signal of the second scanning signal line S2 is the low-level signal, so that the first transistor T1 is turned on, a signal of the first initial signal line INIT1 is provided to the second node N2 to initialize the storage capacitor C, thereby clearing an original data voltage in the storage capacitor. The signals of the first scanning signal line S1 and the light emitting signal line EM are the high-level signals, so that the second transistor T2, the fourth transistor T4, the fifth transistor T5, the sixth transistor T6, and the seventh transistor T7 are turned off In this stage, the OLED does not emit light.

In a second stage A2, referred to as a data writing stage or a threshold compensation stage, a signal of the first scanning signal line S1 is a low-level signal, signals of the second scanning signal line S2 and the light emitting signal line EM are high-level signals, and the data signal line DATA outputs a data voltage. In this stage, the second terminal of the storage capacitor C is at a low level, so that the third transistor T3 is turned on. The signal of the first scanning signal line S1 is the low-level signal, so that the second transistor T2, the fourth transistor T4, and the seventh transistor T7 are turned on. The second transistor T2 and the fourth transistor T4 are turned on so that the data voltage output by the data signal line DATA is provided to the second node N2 through the first node N1, the turned-on third transistor T3, the third node N3, and the turned-on second transistor T2, and a difference between the data voltage output by the data signal line DATA and a threshold voltage of the third transistor T3 is charged into the storage capacitor C, wherein a voltage at the second terminal (the second node N2) of the storage capacitor C is Vdata-Vth, Vdata is the data voltage output by the data signal line DATA, and Vth is the threshold voltage of the third transistor T3. The seventh transistor T7 is turned on, so that an initialization voltage of the second initial signal line INIT2 is provided to a first electrode of the OLED to initialize (reset) the first electrode of the OLED and clear its internal pre-stored voltage, thereby completing initialization and ensuring that the OLED does not emit light. The signal of the second scanning signal line S2 is the high-level signal, so that the first transistor T1 is turned off. The signal of the light emitting signal line EM is the high-level signal, so that the fifth transistor T5 and the sixth transistor T6 are turned off.

In a third stage A3, referred to as a light emitting stage, a signal of the light emitting signal line EM is a low-level signal, and signals of the first scanning signal line S1 and the second scanning signal line S2 are high-level signals. The signal of the light emitting signal line EM is the low-level signal, so that the fifth transistor T5 and the sixth transistor T6 are turned on, a power supply voltage output by the second power supply line VDD provides a driving voltage to the first electrode of the OLED through the turned-on fifth transistor T5, the third transistor T3, and the sixth transistor T6, thereby driving the OLED to emit light.

In an exemplary implementation mode, the data signal driver is provided with a Gamma correction curve, with a black image having a grayscale of 0 as a lowest grayscale, and a white image having a grayscale of 255 as a highest grayscale. The data signal driver provides data voltages for the light emitting unit to display grayscales from 0 to 255 according to the Gamma correction curve. In a driving process of the pixel circuit, a driving current flowing through the third transistor T3 (a driving transistor) is determined by a voltage difference between its control electrode and first electrode. A voltage of the second node N2 is Vdata−Vth, so that the driving current of the third transistor T3 is as follows.

$$I=K^*(Vgs-Vth)^2=K^*[(Vdd-V\text{data}+Vth)-Vth]^2=K^*(Vdd-V\text{data})^2$$

I is the driving current flowing through the third transistor T3, that is, the driving current for driving the OLED, K is a constant, Vgs is the voltage difference between the control electrode and the first electrode of the third transistor T3, Vth is the threshold voltage of the third transistor T3, Vdata is the data voltage output by the data signal line DATA, and Vdd is the power supply voltage output by the second power supply line VDD.

Since a voltage of the OLED and a brightness show a non-linear power-order relationship, if brightness grading is achieved by voltage driving, requirements for a driving voltage are too high and precise, design requirements for a power supply part of a driving circuit are too high, a cost is high, and mass production is unachievable. While a current-brightness curve of the OLED has a near-linear relationship, therefore a current driving method is used. However, use of the current driving method usually results in asynchronous lighting of different pixel points, which is mainly caused by a delay in charging and discharging of a parasitic capacitance existing in a backplane. Due to the asynchronous lighting of different pixel points, in a case of dragging an image or fast refresh, etc., there will be a problem of smearing color cast at an edge of light and dark transition of a picture, such as red smearing and blue smearing, which will seriously affect user experience.

Figure 6:
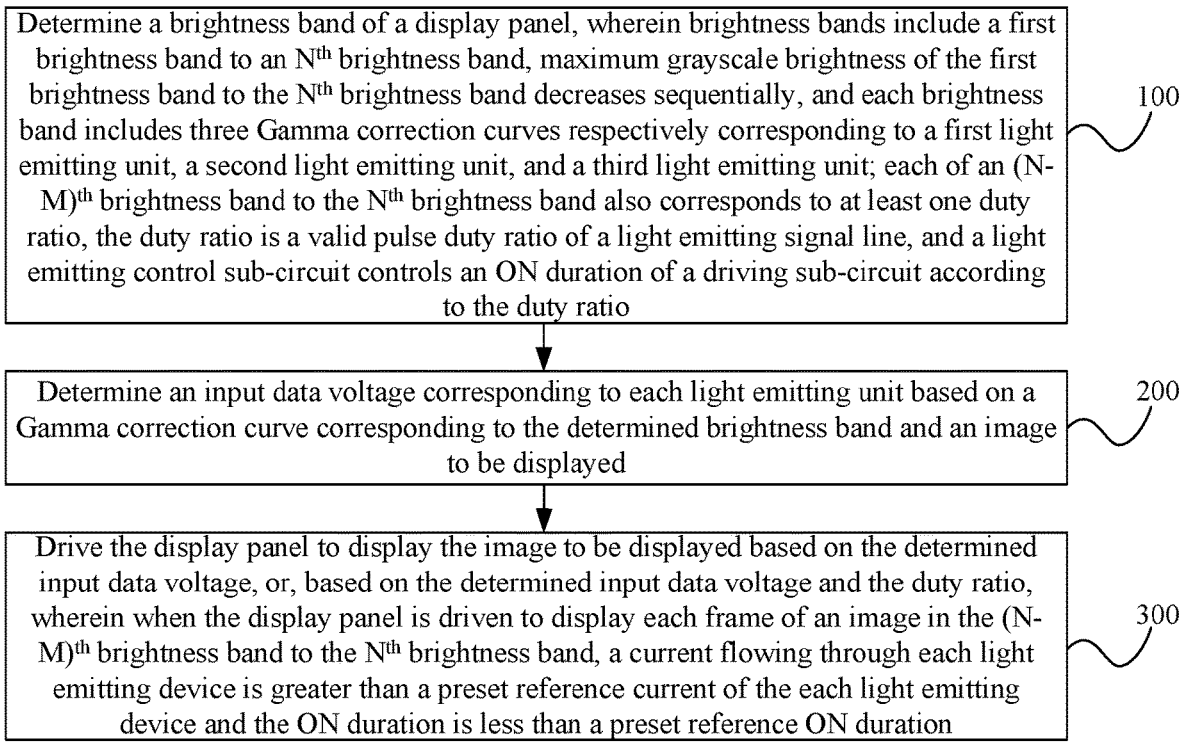
FIG. 6 is a flow chart of a driving method of a display panel according to an exemplary embodiment of the present disclosure.

As shown in FIG. 6, at least one embodiment of the present disclosure provides a driving method of a display panel. The display panel includes multiple pixel units arranged regularly. At least one of the multiple pixel units includes a first light emitting unit that emits light of a first color, a second light emitting unit that emits light of a second color, and a third light emitting unit that emits light of a third color. Each light emitting unit includes a pixel circuit and a light emitting device electrically connected to the pixel circuit. The pixel circuit includes: a driving sub-circuit, a light emitting control sub-circuit, and a data writing sub-circuit, wherein the driving sub-circuit is electrically connected to the light emitting control sub-circuit and the data writing sub-circuit respectively, the data writing sub-circuit is configured to transmit a data voltage, the light emitting control sub-circuit is configured to control an ON duration of the driving sub-circuit, and the driving sub-circuit is configured to control a current flowing through the light emitting device according to the data voltage within the ON duration. The method includes acts 100 to 300.

The act 100 includes: determining a brightness band of a display panel, wherein brightness bands include a first brightness band to an $N^{th}$ brightness band, maximum grayscale brightness of the first brightness band to the $N^{th}$ brightness band decreases sequentially, and each brightness band includes three Gamma correction curves respectively corresponding to a first light emitting unit, a second light emitting unit, and a third light emitting unit; each of an $(N-M)^{th}$ brightness band to the $N^{th}$ brightness band also corresponds to at least one duty ratio, the duty ratio is a valid pulse duty ratio of a light emitting signal line, and a light emitting control sub-circuit controls an ON duration of a driving sub-circuit according to the duty ratio, wherein N is an integer greater than 1, and M is an integer greater than or equal to 0 and less than N.

The act 200 includes: determining an input data voltage corresponding to at least one light emitting unit based on a Gamma correction curve corresponding to the determined brightness band and an image to be displayed.

The act 300 includes: driving the display panel to display the image to be displayed based on the determined input data voltage, or, based on the determined input data voltage and the duty ratio, wherein when the display panel is driven to display each frame of the image in the $(N-M)^{th}$ brightness band to the $N^{th}$ brightness band, a current flowing through each light emitting device is greater than a preset reference current of the each light emitting device and the ON duration is less than a preset reference ON duration.

In the embodiment of the present disclosure, a brightness value in each brightness band is referred to as "grayscale brightness". In the embodiment of the present disclosure, the "grayscale brightness" refers to "brightness" seen visually, i.e., a brightness value of a display screen detected by a brightness detector, which is related to lighting time and actual current brightness. The "current brightness" refers to corresponding brightness of light emitted by a light emitting device in response to a current output by a pixel circuit of a light emitting unit where the light emitting device is located.

In the driving method of a display panel according to the embodiment of the present disclosure, when the display panel is driven to display each frame of the image in the $(N-M)^{th}$ brightness band to the $N^{th}$ brightness band, the current flowing through each light emitting device is greater than the preset reference current of the light emitting device and the ON duration is less than the preset reference ON duration, turn-on time of at least one light emitting unit then tends to be consistent at a low gray-scale brightness, thereby significantly improving the problem of smearing color cast, and improving a display effect of the display panel.

In the embodiment of the present disclosure, the preset reference current is a current, flowing through each light emitting device, in at least one pixel circuit when the data voltage transmitted from the data writing sub-circuit to a pixel circuit of at least one light emitting unit is a preset reference voltage; and the present reference ON duration is an ON duration of the driving sub-circuit under control of the light emitting control sub-circuit when a duty ratio corresponding to each of the $(N-M)^{th}$ brightness band to the $N^{th}$ brightness band is a preset reference duty ratio.

A multi-Band mode is usually used for debugging in Gamma correction to ensure a screen display effect when a Display Brightness Value (DBV) changes. Generally, a digital Integrated Circuit (IC) has more than 10 groups of Gamma registers (each group corresponds to a band) that may be used for the Gamma correction for debugging a DBV curve style. Bands in special modes (for example, a mode of Always On Display (AOD), and a mode of High Brightness Mode (HBM) are removed, and remaining bands are all in a Normal mode.

A Gamma correction curve is derived from a response curve of a Cathode Ray Tube (CRT) display in an early stage, showing a non-linear relationship between output brightness and an input data voltage. In order to make a displayed image more in line with human visual perception, the image needs to be corrected according to the Gamma correction curve. The Gamma correction curve describes a functional relationship between a binary number (that is, a grayscale) and an input data voltage. Generally, a horizontal ordinate of the Gamma correction curve is the binary number, and its horizontal ordinate is the input data voltage corresponding to the binary number. The Gamma correction curve makes the input data voltage and output brightness satisfy a following relationship: $L=C*\alpha^{\gamma}$, wherein L is the output brightness, C is a system constant, $\alpha$ is the input data voltage, and $\gamma$ is its exponent.

Figure 7:
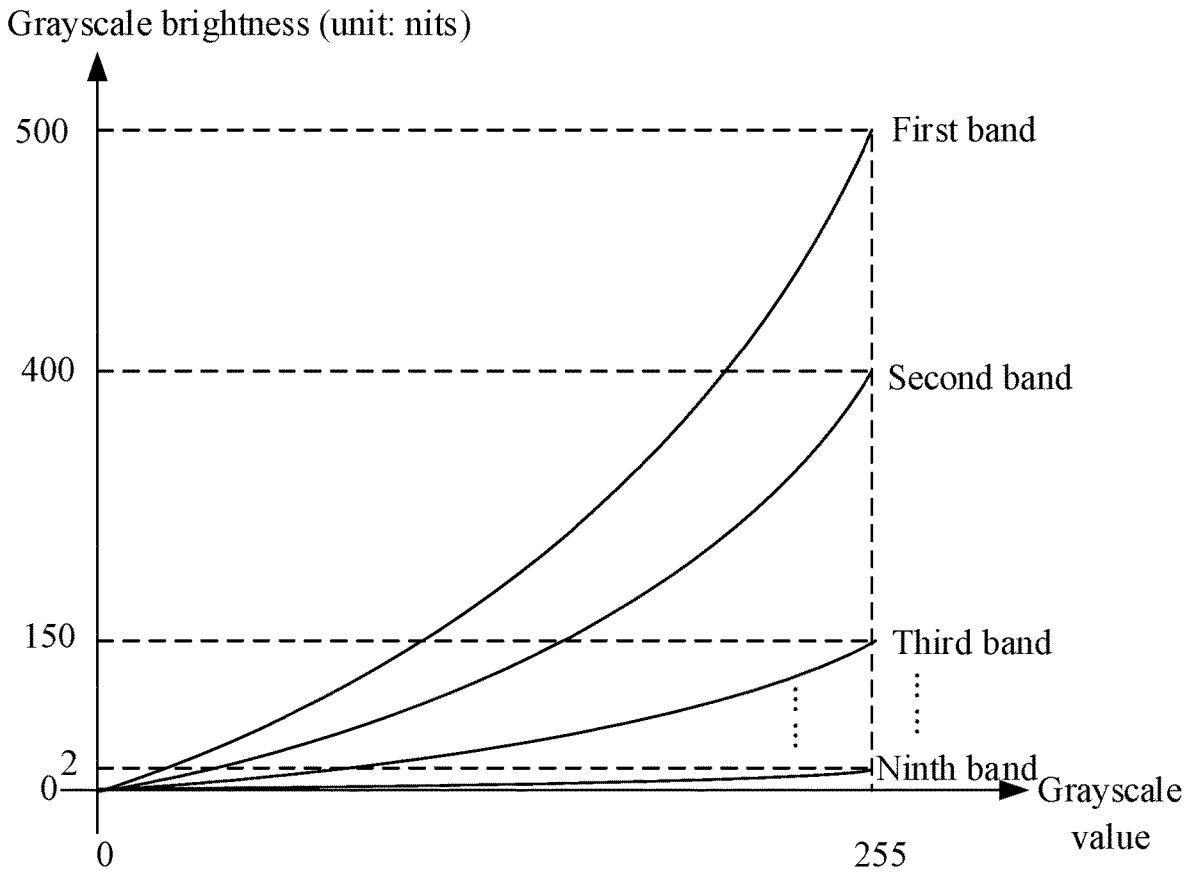
FIG. 7 is a schematic diagram of a Gamma curve according to an exemplary embodiment of the present disclosure.

In an exemplary embodiment, N may be 9, and M may be 1 or 0. As shown in FIG. 7, maximum grayscale brightness from a first band to a ninth band gradually decreases. For example, a grayscale brightness of the first band ranges from 0 to 500 nits, a grayscale brightness range of a second band ranges from 0 to 400 nits, a grayscale brightness of a third band ranges from 0 to 150 nits, . . . , and a grayscale brightness of the ninth band ranges from 0 to 2 nits.

Figure 8:
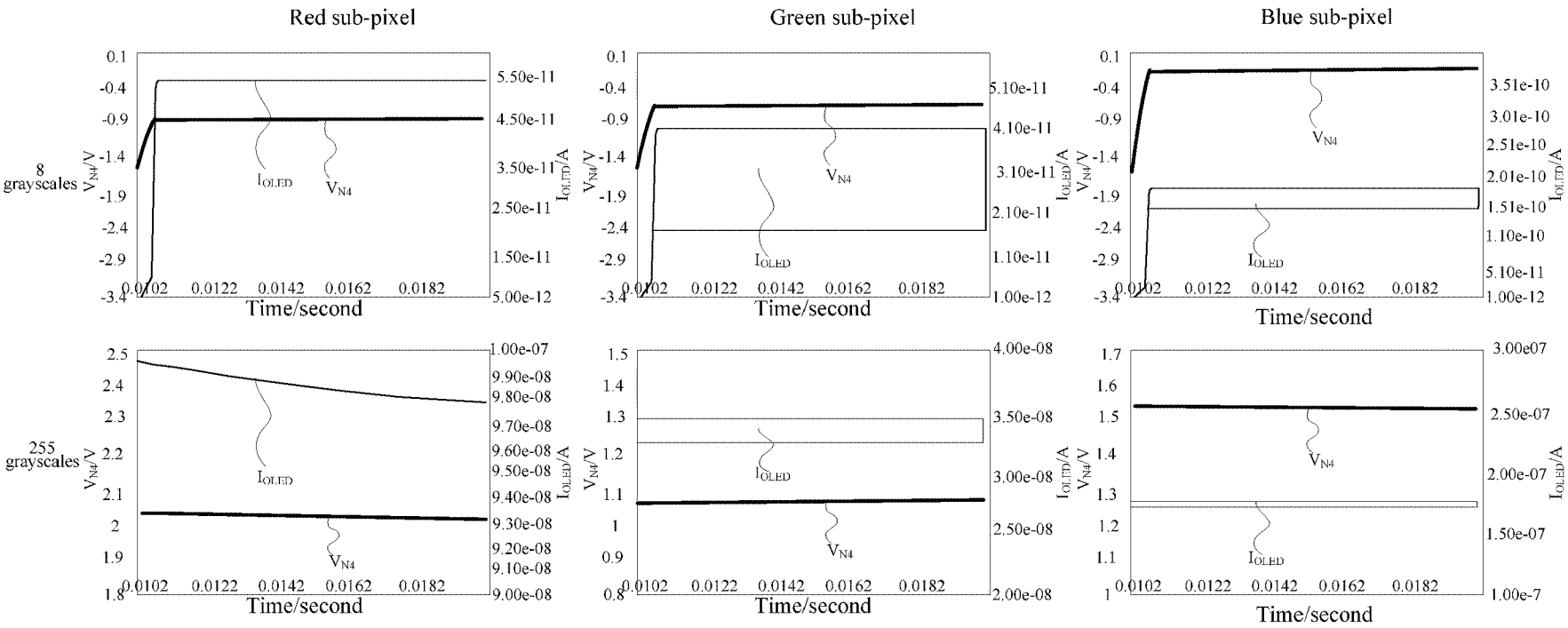
FIG. 8 is a schematic diagram of simulation results of turn-on speeds of Red, Green, Blue (RGB) light emitting units under different grayscales.

As shown in FIG. 8, it may be seen from simulation results of a simulation circuit (transistors in the simulation circuit are P-type transistors) that as a grayscale increases, stable time of a current and a voltage in a first frame is shortened. Since the greater the grayscale is, the greater the current flowing through a light emitting device is, it may be concluded that as the current flowing through the light emitting device increases, stable time of a voltage of a fourth node N4 (i.e. an anode of the light emitting device) is greatly shortened, and turn-on speeds of three RGB light emitting units tend to be consistent.

Figure 9:
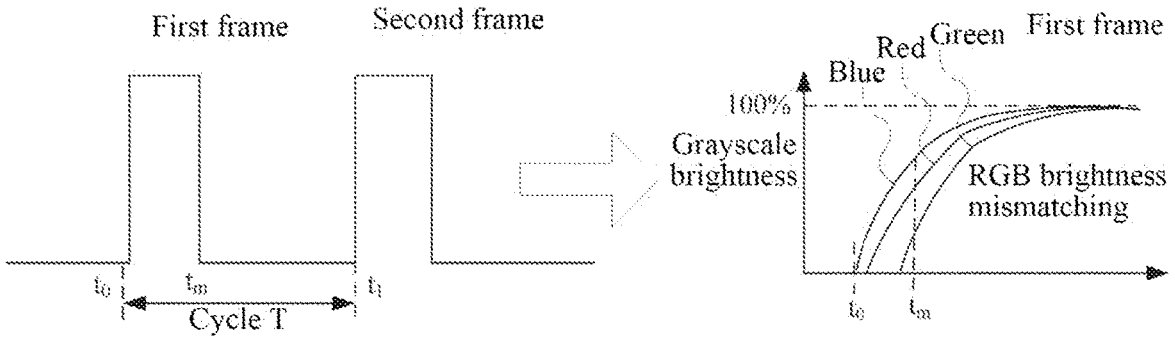
FIG. 9 is a schematic diagram of principle analysis of smearing color cast when a duty ratio is a reference duty ratio.
Figure 10:
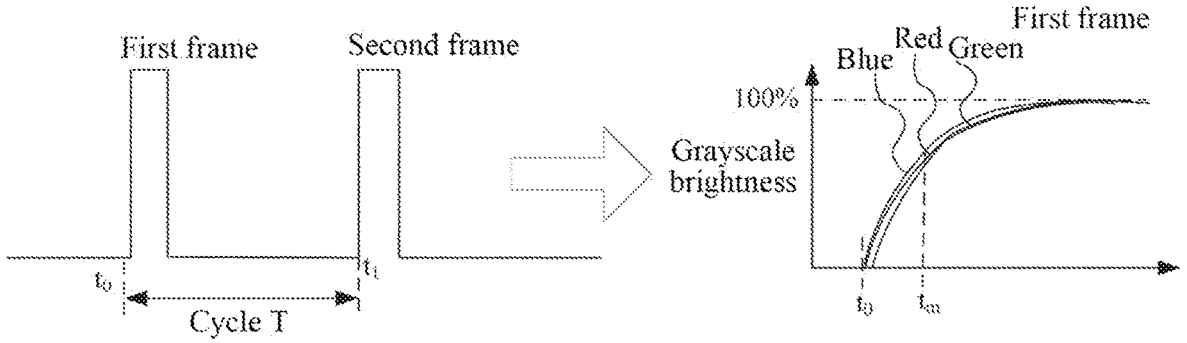
FIG. 10 is a schematic diagram of principle analysis of improvement of smearing color cast when a duty ratio is decreased.

Since the current flowing through the light emitting device increases, a light emitting duration of the light emitting device needs to be reduced without affecting actual grayscale brightness. The light emitting duration of the light emitting device may be adjusted by adjusting a valid pulse duty ratio of a light emitting signal line. The greater the valid pulse duty ratio of the light emitting signal line is, the longer the light emitting time of the light emitting device is, and the higher the actual grayscale brightness is. On the contrary, the smaller the valid pulse duty ratio of the light emitting signal line is, the shorter the light emitting time of the light emitting device is, and the lower the actual grayscale brightness is. When the valid pulse duty ratio is 100%, it means that the light emitting device has a maximum light emitting duration. As shown in FIG. 9 to FIG. 10, by decreasing the valid pulse duty ratio of the light emitting signal line and increasing the current flowing through the light emitting device, it is possible to make a turn-on speed of at least one light emitting unit to be consistent without affecting the actual grayscale brightness, thereby effectively improving a problem of smearing color cast at an edge of light and dark transition of a picture.

In an exemplary embodiment, a duty ratio corresponding to each of the $(N-M)^{th}$ brightness band to the $N^{th}$ brightness band is less than a preset reference duty ratio. By decreasing the duty ratio corresponding to each of the $(N-M)^{th}$ brightness band to the $N^{th}$ brightness band, an ON duration of a light emitting device is less than a preset reference ON duration when the display panel is driven to display each frame of an image in the $(N-M)^{th}$ brightness band to the $N^{th}$ brightness band.

In an exemplary embodiment, the preset reference duty ratio may be 10%.

In an exemplary embodiment, the duty ratio corresponding to each of the $(N-M)^{th}$ to $N^{th}$ brightness band is between 1% and 4%. Exemplarily, the $(N-M)^{th}$ brightness band to the $N^{th}$ brightness band correspond to a duty ratio, and the duty ratio is 2%.

In an exemplary embodiment, multiple transistors in a pixel circuit of each light emitting unit are all P-type transistors, and in multiple Gamma correction curves corresponding to the $(N-M)^{th}$ brightness band to the $N^{th}$ brightness band, a data voltage transmitted from the data writing sub-circuit to a pixel circuit of a first light emitting unit is less than a first reference voltage, a data voltage transmitted from the data writing sub-circuit to a pixel circuit of a second light emitting unit is less than a second reference voltage, and a data voltage transmitted from the data writing sub-circuit to a pixel circuit of a third light emitting unit is less than a third reference voltage, wherein the first reference voltage, the second reference voltage, and the third reference voltage are respectively data voltages transmitted from the data writing sub-circuit to pixel circuits of the first light emitting unit, the second light emitting unit, and the third light emitting unit when a duty ratio corresponding to each of the $(N-M)^{th}$ brightness band to the $N^{th}$ brightness band is a preset reference duty ratio.

In the exemplary embodiment, a decreased duty ratio corresponding to each of the $(N-M)^{th}$ brightness band to the $N^{th}$ brightness band and data voltages that are transmitted from the data writing sub-circuit to the pixel circuits of the first light emitting unit, the second light emitting unit, and the third light emitting unit are directly written into a drive chip, so that a computation workload of the driving chip may be greatly reduced.

When the first to seventh transistors are all P-type transistors, a driving current flowing through the third transistor T3 is as follows.

$$I=K^*(Vgs-Vth)^2=K^*[(Vdd-V\text{data}+Vth)-Vth]^2=K^*(Vdd-V\text{data})^2$$

It may be seen from the above formula that the lower the data voltage Vdata is, the greater the current of the light emitting device is. Since the second power supply line VDD is overlapped with a gate wiring of a switching transistor T2 during a pixel circuit design process, that is, a parasitic capacitance will be generated at an overlapping position of the second power supply line VDD and the gate wiring of the switching transistor T2. In a case where charging and discharging capabilities of the parasitic capacitance are consistent, a magnitude of the data voltage Vdata directly affects a stable speed of the voltage of the fourth node N4.

In the embodiment, in any Gamma correction curve corresponding to the $(N-M)^{th}$ brightness band to the $N^{th}$ brightness band, first reference voltages corresponding to different grayscales are different, and first data voltages corresponding to different grayscales are also different. However, a first data voltage corresponding to a same grayscale is necessarily less than a first reference voltage corresponding to the grayscale.

In any Gamma correction curve corresponding to the $(N-M)^{th}$ brightness band to the $N^{th}$ brightness band, second reference voltages corresponding to different grayscales are different, and second data voltages corresponding to different grayscales are also different. However, a second data voltage corresponding to a same grayscale is necessarily less than a second reference voltage corresponding to the grayscale.

In any Gamma correction curve corresponding to the $(N-M)^{th}$ brightness band to the $N^{th}$ brightness band, third reference voltages corresponding to different grayscales are different, and third data voltages corresponding to different grayscales are also different. However, a third data voltage corresponding to a same grayscale is necessarily less than a third reference voltage corresponding to the grayscale.

In an exemplary embodiment, the first light emitting unit is a red light emitting unit, the second light emitting unit is a green light emitting unit, and the third light emitting unit is a blue light emitting unit.

In an exemplary embodiment, a data voltage transmitted from the data writing sub-circuit to the pixel circuit of the first light emitting unit is about between $^{5}/_{1000}$ and $^{15}/_{1000}$ of the first reference voltage, a data voltage transmitted from the data writing sub-circuit to the pixel circuit of the second light emitting unit is about between $^{10}/_{1000}$ and $^{20}/_{1000}$ of the second reference voltage, and a data voltage transmitted from the data writing sub-circuit to the pixel circuit of the third light emitting unit is about between $^{6}/_{1000}$ and $^{16}/_{1000}$ of the third reference voltage.

For example, in a grayscale of the ninth brightness band (Band 9), when a preset reference duty ratio is 10%, the first reference voltage corresponding to the first light emitting unit is 5.57V, the second reference voltage corresponding to the second light emitting unit is 5.8V, and the third reference voltage corresponding to the third light emitting unit is 5.37V. At this time, blue smearing on a slip boundary of a black image to a white image is apparent.

After the valid pulse duty ratio of the light emitting signal line is decreased to 2%, the data voltage transmitted from the data writing sub-circuit to the pixel circuit of the first light emitting unit is adjusted to 5.52V, the data voltage transmitted from the data writing sub-circuit to the pixel circuit of the second light emitting unit is adjusted to 5.7V, and the data voltage transmitted from the data writing sub-circuit to the pixel circuit of the third light emitting unit is adjusted to 5.31V, so that a problem of smearing is improved greatly without apparent color cast, and a visual effect is better. The method of the present disclosure has a low cost, does not need to change hardware, and is highly implementable.

In another exemplary embodiment of the present disclosure, when the duty ratio corresponding to each of the $(N-M)^{th}$ brightness band to the $N^{th}$ brightness band is a preset reference duty ratio, in multiple Gamma correction curves corresponding to the $(N-M)^{th}$ brightness band to the $N^{th}$ brightness band, data voltages transmitted from the data writing sub-circuit to the pixel circuits of the first light emitting unit, the second light emitting unit, and the third light emitting unit are respectively a first reference voltage, a second reference voltage, and a third reference voltage; and multiple transistors in the pixel circuits are all P-type transistors.

After determining the input data voltage corresponding to at least one light emitting unit, the method further includes: when the determined brightness band is within the $(N-M)^{th}$ brightness band to the $N^{th}$ brightness band, decreasing a duty ratio corresponding to the determined brightness band, decreasing an input data voltage corresponding to the at least one light emitting unit, and making brightness that is generated by using the decreased duty ratio and the decreased input data voltage corresponding to the at least one light emitting unit be equal to grayscale brightness that is generated by using the preset reference duty ratio and the first reference voltage, the second reference voltage, and the third reference voltage.

In another exemplary embodiment of the present disclosure, the duty ratio corresponding to each of the $(N-M)^{th}$ brightness band to the $N^{th}$ brightness band is less than a preset reference duty ratio.

Multiple transistors in a pixel circuit of each light emitting unit are all N-type transistors. In multiple Gamma correction curves corresponding to the $(N-M)^{th}$ brightness band to the $N^{th}$ brightness band, a data voltage transmitted from the data writing sub-circuit to the pixel circuit of the first light emitting unit is greater than a first reference voltage, a data voltage transmitted from the data writing sub-circuit to the pixel circuit of the second light emitting unit is greater than a second reference voltage, and a data voltage transmitted from the data writing sub-circuit to the pixel circuit of the third light emitting unit is greater than a third reference voltage, wherein the first reference voltage, the second reference voltage, and the third reference voltage are respectively data voltages transmitted from the data writing sub-circuit to the pixel circuits of the first light emitting unit, the second light emitting unit, and the third light emitting unit when the duty ratio corresponding to each of the $(N-M)^{th}$ brightness band to the $N^{th}$ brightness band is the preset reference duty ratio.

When the first to seventh transistors are all N-type transistors (at this time, positions of the first transistor T1, the seventh transistor T7, and the storage capacitor C in FIG. 4 may be adjusted as follows: the first electrode of the first transistor T1 is connected to the second power supply line VDD, the second electrode of the first transistor T1 is still connected to the second node N2, the control electrode of the first transistor T1 is still connected to the second scanning signal line S2, the control electrode of the seventh transistor T7 is connected to a third scanning signal line S3, the first electrode of the seventh transistor T7 is still connected to the second initial signal line INIT2, the second electrode of the seventh transistor T7 is still connected to the fourth node N4, the first terminal of the storage capacitor C is connected to the fourth node N4, the second terminal of the storage capacitor C is still connected to the second node N2, and position/connection relationships of other transistors are still the same as those in FIG. 4), the driving current flowing through the third transistor T3 is as follows.

$$I=K^*(Vgs-Vth)^2=K^*[(Vdd-V\text{data}+Vth)-Vth]^2=K^*(Vdd-V\text{data})^2$$

It may be seen from the above formula that when the first to seventh transistors are all N-type transistors, a current input to a light emitting device of the at least one light emitting unit may be increased by increasing the data voltage Vdata output by the data signal line DATA. The higher the data voltage Vdata is, the greater the current of the light emitting device is.

In the embodiment, in any Gamma correction curve corresponding to the $(N-M)^{th}$ brightness band to the $N^{th}$ brightness band, first reference voltages corresponding to different grayscales are different, and first data voltages corresponding to different grayscales are also different. However, a first data voltage corresponding to a same grayscale is necessarily greater than a first reference voltage corresponding to the grayscale.

In any Gamma correction curve corresponding to the $(N-M)^{th}$ brightness band to the $N^{th}$ brightness band, second reference voltages corresponding to different grayscales are different, and second data voltages corresponding to different grayscales are also different. However, a second data voltage corresponding to a same grayscale is necessarily greater than a second reference voltage corresponding to the grayscale.

In any Gamma correction curve corresponding to the $(N-M)^{th}$ brightness band to the $N^{th}$ brightness band, third reference voltages corresponding to different grayscales are different, and third data voltages corresponding to different grayscales are also different. However, a third data voltage corresponding to a same grayscale is necessarily greater than a third reference voltage corresponding to the grayscale.

In another exemplary embodiment of the present disclosure, when the duty ratio corresponding to each of the $(N-M)^{th}$ brightness band to the $N^{th}$ brightness band is a preset reference duty ratio, in multiple Gamma correction curves corresponding to the $(N-M)^{th}$ brightness band to the $N^{th}$ brightness band, data voltages transmitted from the data writing sub-circuit to the pixel circuits of the first light emitting unit, the second light emitting unit, and the third light emitting unit are respectively a first reference voltage, a second reference voltage, and a third reference voltage; and multiple transistors in the pixel circuits are all N-type transistors.

After determining the input data voltage corresponding to at least one light emitting unit, the method further includes: when the determined brightness band is within the $(N-M)^{th}$ brightness band to the $N^{th}$ brightness band, decreasing a duty ratio corresponding to the determined brightness band, increasing the input data voltage corresponding to the at least one light emitting unit, and making brightness that is generated by using the decreased duty ratio and the increased input data voltage corresponding to the at least one light emitting unit be equal to grayscale brightness that is generated by using the preset reference duty ratio and the first reference voltage, the second reference voltage, and the third reference voltage.

In the driving method of a display panel according to the embodiment of the present disclosure, by increasing an input data voltage corresponding to at least one light emitting unit in a low-brightness band, a current flowing through each light emitting device is increased, and a valid pulse duty ratio of a light emitting signal line is reduced, so that an ON duration is shortened, and an RGB turn-on speed tends to be consistent without affecting actual grayscale brightness. In a first frame or first few frames during a smearing process, RGB brightness is matched to a white balance, so that a problem of smearing color cast is significantly improved, and a display effect of the display panel is improved. The method is low in cost, requires no change of hardware, and is highly implementable.

An exemplary embodiment of the present disclosure also provides a display panel, which is driven by using the driving method of a display panel in any one of the foregoing embodiments.

An exemplary embodiment of the present disclosure also provides a display apparatus, including the foregoing display panel. The display apparatus may be: a mobile phone, a tablet computer, a television, a display apparatus, a laptop computer, a digital photo frame or a navigator, or any other product or component with a display function.

Although the implementation modes disclosed in the present disclosure are stated above, the contents are only the implementation modes used for convenience of understanding the present disclosure and are not used for limiting the present disclosure. Any person skilled in the art to which the present disclosure belongs may make any modification and variation in forms and details of implementation without departing from the spirit and scope disclosed in the present disclosure. However, the scope of patent protection of the present disclosure shall still be subject to the scope defined in the appended claims.

The invention claimed is:

1. A driving method of a display panel, the display panel comprising multiple pixel units arranged regularly, at least one of the multiple pixel units comprising a first light emitting unit that emits light of a first color, a second light emitting unit that emits light of a second color, and a third light emitting unit that emits light of a third color, each light emitting unit comprising a pixel circuit and a light emitting device electrically connected to the pixel circuit, and the pixel circuit comprising: a driving sub-circuit, a light emitting control sub-circuit, and a data writing sub-circuit, wherein the driving sub-circuit is electrically connected to the light emitting control sub-circuit and the data writing sub-circuit respectively, the data writing sub-circuit is configured to transmit a data voltage, the light emitting control sub-circuit is configured to control an ON duration of the driving sub-circuit, and the driving sub-circuit is configured to control a current flowing through the light emitting device according to the data voltage within the ON duration; the driving method comprising:

determining a brightness band of the display panel, wherein brightness bands comprise a first brightness band to an $N^{th}$ brightness band, maximum grayscale brightness of the first brightness band to the $N^{th}$ brightness band decreases sequentially, and each brightness band comprises three Gamma correction curves respectively corresponding to the first light emitting unit, the second light emitting unit, and the third light emitting unit; each of an $(N-M)^{th}$ brightness band to the $N^{th}$ brightness band also corresponds to at least one duty ratio, the duty ratio is a valid pulse duty ratio of a light emitting signal line, and the light emitting control sub-circuit controls the ON duration of the driving sub-circuit according to the duty ratio, wherein N is an integer greater than 1, and M is an integer greater than or equal to 0 and less than N;

determining an input data voltage corresponding to at least one light emitting unit based on a Gamma correction curve that corresponds to the determined brightness band and an image to be displayed; and driving the display panel to display the image to be displayed based on the determined input data voltage, or, based on the determined input data voltage and the duty ratio, wherein when the display panel is driven to display each frame of an image in the $(N-M)^{th}$ brightness band to the $N^{th}$ brightness band, a current flowing through each light emitting device is greater than a preset reference current of the each light emitting device and an ON duration is less than a preset reference ON duration.

2. The driving method according to claim 1, wherein the duty ratio corresponding to each of the $(N-M)^{th}$ brightness band to the $N^{th}$ brightness band is less than a preset reference duty ratio;

multiple transistors in the pixel circuit are all P-type transistors, and in multiple Gamma correction curves corresponding to the $(N-M)^{th}$ brightness band to the $N^{th}$ brightness band, a data voltage transmitted from the data writing sub-circuit to a pixel circuit of the first light emitting unit is less than a first reference voltage, a data voltage transmitted from the data writing sub-circuit to a pixel circuit of the second light emitting unit is less than a second reference voltage, and a data voltage transmitted from the data writing sub-circuit to a pixel circuit of the third light emitting unit is less than a third reference voltage, wherein the first reference voltage, the second reference voltage, and the third reference voltage are respectively data voltages transmitted from the data writing sub-circuit to pixel circuits of the first light emitting unit, the second light emitting unit, and the third light emitting unit when the duty ratio corresponding to each of the $(N-M)^{th}$ brightness band to the $N^{th}$ brightness band is the preset reference duty ratio.

3. The driving method according to claim 2, wherein the data voltage transmitted from the data writing sub-circuit to the pixel circuit of the first light emitting unit is between $5/1000$ and $15/1000$ of the first reference voltage, the data voltage transmitted from the data writing sub-circuit to the pixel circuit of the second light emitting unit is between $10/1000$ and $20/1000$ of the second reference voltage, and the data voltage transmitted from the data writing sub-circuit to the pixel circuit of the third light emitting unit is between $6/1000$ and $16/1000$ of the third reference voltage.

4. The driving method according to claim 1, wherein the duty ratio corresponding to each of the $(N-M)^{th}$ brightness band to the $N^{th}$ brightness band is less than a preset reference duty ratio;

multiple transistors in the pixel circuit are all N-type transistors, and in multiple Gamma correction curves corresponding to the $(N-M)^{th}$ brightness band to the $N^{th}$ brightness band, a data voltage transmitted from the data writing sub-circuit to a pixel circuit of the first light emitting unit is greater than a first reference voltage, a data voltage transmitted from the data writing sub-circuit to a pixel circuit of the second light emitting unit is greater than a second reference voltage, and a data voltage transmitted from the data writing sub-circuit to a pixel circuit of the third light emitting unit is greater than a third reference voltage, wherein the first reference voltage, the second reference voltage, and the third reference voltage are respectively data voltages transmitted from the data writing sub-circuit to pixel circuits of the first light emitting unit, the second light emitting unit, and the third light emitting unit when the duty ratio corresponding to each of the $(N-M)^{th}$ brightness band to the $N^{th}$ brightness band is the preset reference duty ratio.

5. The driving method according to claim 1, wherein the duty ratio corresponding to each of the $(N-M)^{th}$ brightness band to the $N^{th}$ brightness band is a preset reference duty ratio, in multiple Gamma correction curves corresponding to the $(N-M)^{th}$ brightness band to the $N^{th}$ brightness band, data voltages transmitted from the data writing sub-circuit to pixel circuits of the first light emitting unit, the second light emitting unit, and the third light emitting unit are respectively a first reference voltage, a second reference voltage, and a third reference voltage; multiple transistors in the pixel circuits are all P-type transistors, and after determining the input data voltage corresponding to at least one light emitting unit, the method further comprises:

when the determined brightness band is within the $(N-M)^{th}$ brightness band to the $N^{th}$ brightness band, decreasing a duty ratio corresponding to the determined brightness band, decreasing the input data voltage corresponding to the at least one light emitting unit, and making brightness that is generated by using the decreased duty ratio and the decreased input data voltage corresponding to the at least one light emitting unit be equal to grayscale brightness that is generated by using the preset reference duty ratio and the first reference voltage, the second reference voltage, and the third reference voltage.

6. The driving method according to claim 1, wherein the duty ratio corresponding to each of the $(N-M)^{th}$ brightness band to the $N^{th}$ brightness band is a preset reference duty ratio, in multiple Gamma correction curves corresponding to the $(N-M)^{th}$ brightness band to the $N^{th}$ brightness band, data voltages transmitted from the data writing sub-circuit to pixel circuits of the first light emitting unit, the second light emitting unit, and the third light emitting unit are respectively a first reference voltage, a second reference voltage, and a third reference voltage; multiple transistors in the pixel circuits are all N-type transistors, and after determining the input data voltage corresponding to at least one light emitting unit, the method further comprises:

when the determined brightness band is within the $(N-M)^{th}$ brightness band to the $N^{th}$ brightness band, decreasing a duty ratio corresponding to the determined brightness band, increasing the input data voltage corresponding to the at least one light emitting unit, and making brightness that is generated by using the decreased duty ratio and the increased input data voltage corresponding to the at least one light emitting unit be equal to grayscale brightness that is generated by using the preset reference duty ratio and the first reference voltage, the second reference voltage, and the third reference voltage.

7. The driving method according to claim 1, wherein N is 9, and M is 1 or 0.

8. The driving method according to claim 1, wherein the duty ratio corresponding to each of the $(N-M)^{th}$ brightness band to the $N^{th}$ brightness band is between 1% and 4%.

9. A display panel, which is driven by using the driving method of a display panel according to claim 1.

10. The display panel according to claim 9, wherein the first light emitting unit is a red light emitting unit, the second light emitting unit is a green light emitting unit, and the third light emitting unit is a blue light emitting unit.

11. The display panel according to claim 9, wherein the pixel circuit comprises:

a first transistor, a control electrode of the first transistor being connected to a second scanning signal line, a first electrode of the first transistor being connected to a first initial signal line, and a second electrode of the first transistor being connected to a second node;

a second transistor, a control electrode of the second transistor being connected to a first scanning signal line, a first electrode of the second transistor being connected to the second node, and a second electrode of the second transistor being connected to a third node;

a third transistor, a control electrode of the third transistor being connected to the second node, a first electrode of the third transistor being connected to a first node, and a second electrode of the third transistor being connected to the third node;

a fourth transistor, a control electrode of the fourth transistor being connected to the first scanning signal line, a first electrode of the fourth transistor being connected to a data signal line, and a second electrode of the fourth transistor being connected to the first node;

a fifth transistor, a control electrode of the fifth transistor being connected to a light emitting signal line, a first electrode of the fifth transistor being connected to a second power supply line, and a second electrode of the fifth transistor being connected to the first node;

a sixth transistor, a control electrode of the sixth transistor being connected to the light emitting signal line, a first electrode of the sixth transistor being connected to the third node, and a second electrode of the sixth transistor being connected to a first electrode of a light emitting device;

a seventh transistor, a control electrode of the seventh transistor being connected to the first scanning signal line, a first electrode of the seventh transistor being connected to a second initial signal line, and a second electrode of the seventh transistor being connected to the first electrode of the light emitting device, a second electrode of the light emitting device being connected to the first power supply line; and a storage capacitor, a first terminal of the storage capacitor being connected to the second power supply line and a second terminal of the storage capacitor being connected to the second node.

12. The display panel according to claim 9, wherein in a plane perpendicular to the display panel, the display panel comprises a driving circuit layer arranged on a base substrate, a light emitting structure layer arranged on the driving circuit layer, and an encapsulation layer arranged on the light emitting structure layer, the driving circuit layer comprises a transistor and a storage capacitor constituting a pixel circuit, and the light emitting structure layer comprises an anode, a pixel definition layer, an organic light emitting layer, and a cathode.

13. The display panel according to claim 9, wherein the display panel comprises a display region and a non-display region, multiple light emitting units are located in the display region, and the display panel comprises a scanning signal driver, a timing controller, and a clock signal line that are located in the non-display region, the scanning signal driver is connected to a first scanning signal line and a second scanning signal line, the clock signal line is connected to the timing controller and the scanning signal driver respectively, and the clock signal line is configured to provide a clock signal to the scanning signal driver under control of the timing controller.

14. A display apparatus, comprising the display panel according to claim 9.

15. The driving method according to claim 2, wherein N is 9, and M is 1 or 0.

16. The driving method according to claim 3, wherein N is 9, and M is 1 or 0.

17. The driving method according to claim 4, wherein N is 9, and M is 1 or 0.

18. The driving method according to claim 2, wherein the duty ratio corresponding to each of the $(N-M)^{th}$ brightness band to the $N^{th}$ brightness band is between 1% and 4%.

19. The driving method according to claim 3, wherein the duty ratio corresponding to each of the $(N-M)^{th}$ brightness band to the $N^{th}$ brightness band is between 1% and 4%.

20. The driving method according to claim 4, wherein the duty ratio corresponding to each of the $(N-M)^{th}$ brightness band to the $N^{th}$ brightness band is between 1% and 4%.

* * * * *